US010428530B2

(12) United States Patent
Holland et al.

(10) Patent No.: US 10,428,530 B2
(45) Date of Patent: Oct. 1, 2019

(54) ENTANGLED MESH ROOF VENT WITH INTEGRATED EXTERNAL BAFFLE

(71) Applicant: Air Vent, Inc., Dallas, TX (US)

(72) Inventors: Robert B. Holland, Rowlett, TX (US); Grayson M. Griffin, Grand Prairie, TX (US)

(73) Assignee: AIR VENT, INC., Dallas, TX (US)

( * ) Notice: Subject to any disclaimer, the term of this patent is extended or adjusted under 35 U.S.C. 154(b) by 0 days.

(21) Appl. No.: 15/664,397

(22) Filed: Jul. 31, 2017

(65) Prior Publication Data

US 2018/0038112 A1 Feb. 8, 2018

Related U.S. Application Data

(60) Provisional application No. 62/370,267, filed on Aug. 3, 2016.

(51) Int. Cl.
*E04D 13/17* (2006.01)
*F24F 7/02* (2006.01)

(52) U.S. Cl.
CPC ..... *E04D 13/176* (2013.01); *E04D 13/174* (2013.01); *E04D 13/178* (2013.01); *F24F 7/02* (2013.01); *F24F 2221/52* (2013.01)

(58) Field of Classification Search
CPC ..... E04D 13/176; E04D 13/178; F24F 7/02; F24F 2221/52
See application file for complete search history.

(56) References Cited

U.S. PATENT DOCUMENTS

| | | | | |
|---|---|---|---|---|
| 4,000,688 | A | 1/1977 | Malott | |
| 4,325,290 | A | 4/1982 | Wolfert | |
| 4,643,080 | A | 2/1987 | Trostle et al. | |
| 4,754,589 | A * | 7/1988 | Leth | B28B 5/04 49/475.1 |
| 4,942,699 | A | 7/1990 | Spinelli | |
| 5,002,816 | A * | 3/1991 | Hofmann | E04D 1/36 428/138 |
| 5,122,095 | A | 6/1992 | Wolfert | |
| 5,561,953 | A * | 10/1996 | Rotter | E04D 3/30 454/365 |
| 5,673,521 | A | 10/1997 | Coulton et al. | |
| 5,772,502 | A | 6/1998 | Smith | |
| 5,832,677 | A | 11/1998 | Kurttila | |
| 5,946,868 | A * | 9/1999 | Morris | E04D 13/174 454/365 |
| 5,947,817 | A | 9/1999 | Morris et al. | |
| 5,972,477 | A * | 10/1999 | Kim | B32B 3/28 428/175 |

(Continued)

OTHER PUBLICATIONS

RidgeVent20, Product Features and Specifications, Air Vent Inc., 2013, 2 pages.

*Primary Examiner* — Brian E Glessner
*Assistant Examiner* — Omar F Hijaz
(74) *Attorney, Agent, or Firm* — Duane Morris LLP

(57) ABSTRACT

A roof vent includes a continuous elongate mat composed of a mesh of randomly oriented fibers. The mat has a top surface, a bottom surface, and a first longitudinally extending side surface. A portion of the mat proximate to and forming the first longitudinally extending side surface is configured as a wind baffle. The wind baffle includes a wind deflector lip, formed from the mesh, which extends above the top surface of the mat.

20 Claims, 5 Drawing Sheets

(56) References Cited

U.S. PATENT DOCUMENTS

| | | | | |
|---|---|---|---|---|
| 6,149,517 | A * | 11/2000 | Hansen | E04D 13/174 454/365 |
| 6,343,985 | B1 * | 2/2002 | Smith | E04D 13/176 454/365 |
| 6,447,392 | B1 | 9/2002 | Henderson | |
| 6,881,144 | B2 | 4/2005 | Hansen et al. | |
| 6,991,535 | B2 | 1/2006 | Ciepliski et al. | |
| 7,182,688 | B2 | 2/2007 | Coulton | |
| 7,594,363 | B2 * | 9/2009 | Polumbus | E04D 13/174 454/365 |
| 7,766,735 | B2 | 8/2010 | Ciepliski et al. | |
| 7,892,077 | B2 * | 2/2011 | Sattler | E04D 13/176 454/250 |
| 8,828,162 | B2 * | 9/2014 | Peyras-Carratte | A47L 13/16 156/62.2 |
| 9,200,453 | B2 | 12/2015 | Kerwood-Winslow et al. | |
| 9,303,340 | B2 * | 4/2016 | Rones | D04H 1/732 |
| 2002/0100232 | A1 * | 8/2002 | Robinson | E04D 13/176 52/198 |
| 2005/0136831 | A1 * | 6/2005 | Coulton | E04D 13/174 454/365 |
| 2006/0096189 | A1 * | 5/2006 | Pavlansky | E04D 13/174 52/198 |
| 2008/0220714 | A1 * | 9/2008 | Caruso | E04D 13/152 454/365 |
| 2011/0189940 | A1 * | 8/2011 | Kerwood-Winslow | E04D 13/17 454/365 |
| 2013/0165038 | A1 * | 6/2013 | Railkar | E04D 13/176 454/365 |
| 2014/0179220 | A1 | 6/2014 | Railkar et al. | |

* cited by examiner

ENTANGLED MESH ROOF VENT WITH INTEGRATED EXTERNAL BAFFLE

CROSS-REFERENCE TO RELATED APPLICATIONS

This application claims priority to U.S. Provisional Patent Application Ser. No. 62/370,267 filed Aug. 3, 2016, the entirety of which is incorporated herein by reference.

FIELD OF THE INVENTION

The present disclosure relates to vents for roofs and more specifically to ridge vents having integral baffles.

BACKGROUND

In home construction, an open slot along the roof ridge where two planes of the roof meet is often covered by a device that protects the slot from weather infiltration while allowing venting of heat and moisture from the attic space to the exterior of the home. The device has become known as a ridge vent. Current ridge vents are made of metal, plastic or non-woven/entangled mesh. The mesh type ridge vents may include a hard plastic or fabric covering. Mesh type ridge vents may include voids, gaps or air pockets between longitudinally extending mesh sections. These vents are often formed by adhering mesh sections to a separate component (e.g., the aforementioned hard plastic or fabric covering), leaving gaps of no mesh.

SUMMARY

In embodiments, a roof vent includes a continuous elongate mat composed of a mesh of randomly oriented fibers. The mat has a top surface, a bottom surface, and a first longitudinally extending side surface. A portion of the mat proximate to and forming the first longitudinally extending side surface is configured as a wind baffle. The wind baffle includes a wind deflector lip, formed from the mesh, which extends above the top surface of the mat.

In embodiments, a continuous elongate mat composed of a mesh of randomly oriented fibers, wherein the mat has a top surface, a bottom surface, a longitudinally extending center section disposed between first and second longitudinally extending side surfaces, first and second longitudinally extending edge sections disposed between the center section and including the first and second longitudinally extending side surfaces, respectively. The first and second longitudinally extending edge sections each include a non-venting fiber region proximate to and forming the first and second side surfaces, respectively, configured as a wind baffle formed from the mesh, and a venting fiber region disposed between the non-venting fiber region and the longitudinally extending center region of the mat. The longitudinally extending center section has a first air permeability, the venting fiber regions of the first and second longitudinally extending edge sections have a second air permeability less than the first air permeability, and the non-venting fiber regions of the first and second longitudinally extending edge sections have a third air permeability less than second air permeability. The vent is configured such that an air flow path for venting air from a structure to which the vent is coupled is formed from the longitudinally extending center section through the first and second longitudinally extending edge sections to the surrounding environment when an upper surface of the longitudinally extending center section is covered and the venting fiber regions of the first and second longitudinally extending edge sections are exposed.

In embodiments, a roof vent assembly includes: a roof deck with an open elongate slot; a roof vent overlying the open elongate slot, wherein the roof vent includes a rollable, continuous elongate mat composed of a mesh of randomly oriented fibers, wherein the mat has a top surface, a bottom surface, and a first longitudinally extending side surface, wherein a portion of the mat proximate to and forming the first longitudinally extending side surface is configured as a wind baffle, wherein the wind baffle includes a wind deflector lip, formed from the mesh, which extends above the top surface of the mat; and at least one cap shingle overlying the roof vent and the open elongate slot. The cap shingle partially overlies the top surface of the openwork material, such that a portion of the roof vent disposed between the wind baffle and the cap shingle is exposed to provide a ventilation opening.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
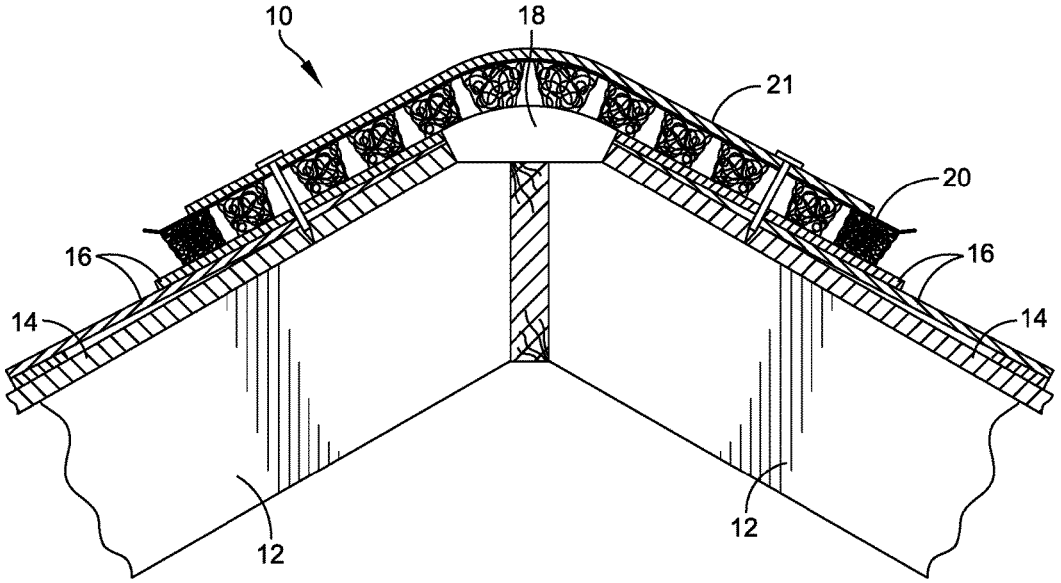
FIG. 1 is a cross-sectional side view of one embodiment of a roof ridge vent assembly.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Ridge vents can include baffles along a longitudinal edge of the ridge vent to manage the airflow around the ridge vent and increase the effectiveness of the ventilation. The baffle may be a separate component that is affixed to the ridge vent either during manufacturing or during installation. This process increases the costs and/or time for manufacture and installation.

The ridge vents described herein include integrally formed external baffles or baffle surfaces. These ridge vents restrict the ingress of materials and weather into the home while allowing for the venting of air and moisture from the home. Such ridge vents with integrally formed baffles are economical, and simple to manufacture and install, as compared to ridge vents with external baffles which require assembly to the ridge vent. The ridge vents can be installed over an open elongate slot on a roof ridge to allow the venting of air and moisture from the attic or other area of a home. This venting helps ensure that moisture does not build up inside the home.

FIG. 1 shows an exemplary roof ridge assembly 10. The roof ridge assembly 10 includes rafters 12 and a roof deck 14 secured to the rafters 12. Shingles 16 are secured to the roof deck 14. The roof deck 14 can be constructed of plywood or other material. An open elongate slot 18 is provided along the length of the roof ridge assembly 10. The open elongate slot 18 allows for the venting of air from the home.

Figure 4:
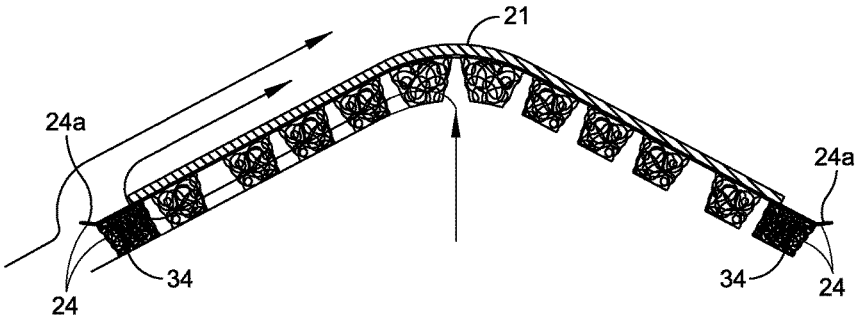
FIG. 4 is a cross-sectional side view of the roof ridge vent of FIG. 2 showing the direction of airflow of exhaust air.

The open elongate slot 18 is covered by a ridge vent 20 and a plurality of cap shingles 21. As shown in FIG. 1, the cap shingles 21 cover a portion of the ridge vent 20 but leave a portion of the ridge vent 20 uncovered. As a result, air is able to travel from the home, through the open elongate slot 18, and out through the ridge vent 20, as shown in FIG. 4. At the same time, the cap shingle 21 and ridge vent 20 prevent material from entering the home through the open elongate slot 18.

Figure 2:
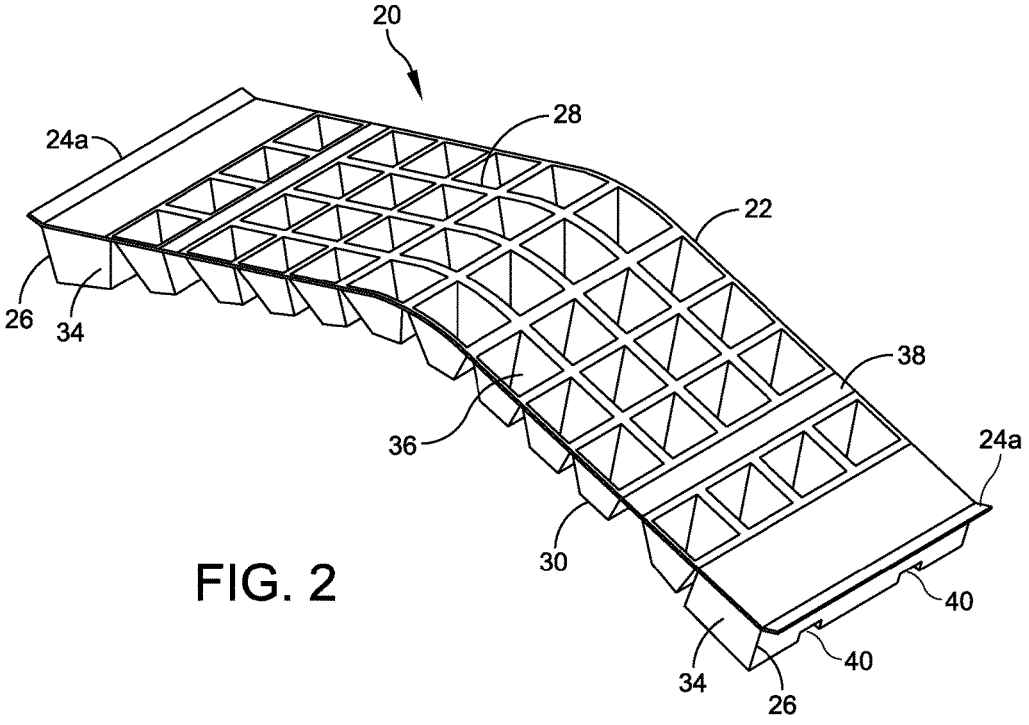
FIG. 2 is an isometric view of an embodiment of a roof ridge vent.
Figure 3:
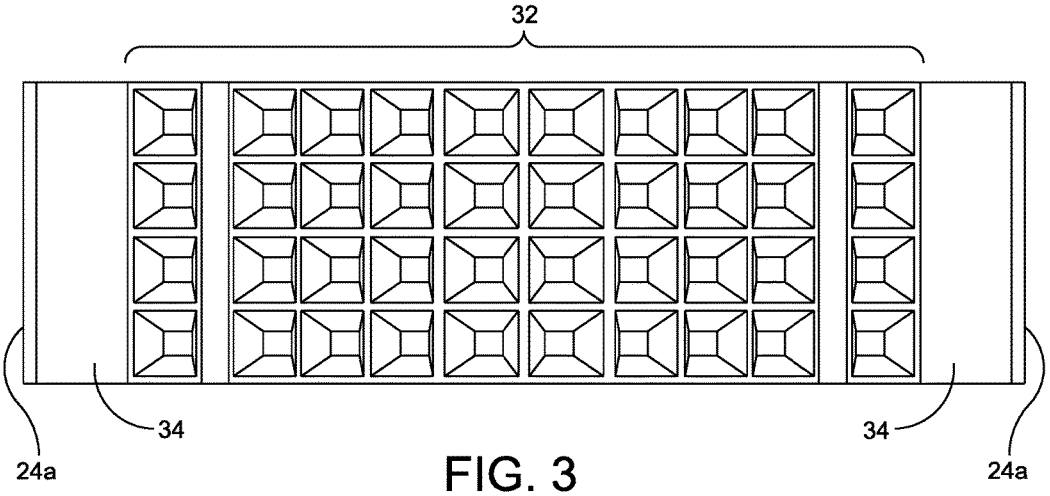
FIG. 3 is a top view of the roof ridge vent of FIG. 2.
Figure 5:
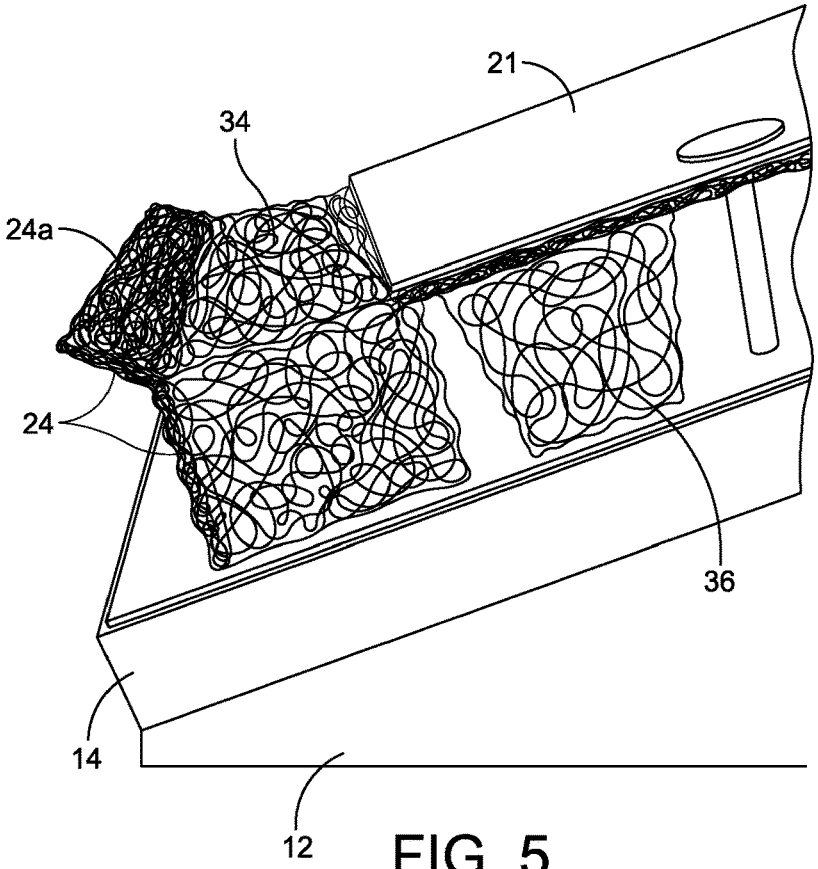
FIG. 5 is a detail view of a roof ridge vent according to the embodiment of FIG. 2.

FIGS. 2 and 3 are provided to show the general shape of the ridge vent 20, which is arranged in an openwork configuration, without illustrating the fibrous nature mat material from which the vent is formed (as illustrated in, for example, FIGS. 1, 4 and 5). In an embodiment, as shown in FIGS. 2-3, a ridge vent 20 includes a fibrous sheet or mat 22 of randomly oriented fibers. The sheet or mat 22 defines a top surface 28 and a bottom surface 30. The ridge vent 20 includes a pair of integrated external baffles or baffle surfaces 24 (described in more detail in connection with FIG. 5) including a wind deflector lip 24*a* extending above the upper top surface 28 and angled outward of the longitudinally extending edges 26 of the sheet or mat 22. Optionally, the material 22 is constructed of sections of varying density mesh to control the airflow through the ridge vent 20. The baffles 24 and wind deflector lip 24*a* are formed out of the same material and can be formed by stamping, ironing, melting, molding, or otherwise shaping the material. The ridge vent 20 can be rolled for distribution or flat cut into sections. The ridge vent 20 can be of varying widths to cover the open elongate slot 18 in a roof structure 10. In one embodiment, the width of the ridge vent 20 is between about 7 inches and 15 inches. The ridge vent 20 can be provided in any length and preferably in sufficient lengths to fully cover the elongate slot 18 in the roof ridge assembly 10. In one embodiment, the ridge vent is between about 2 feet and 50 feet long.

The fibrous mat includes randomly oriented or convoluted fibers or filaments. The material can be constructed from polyvinyl chloride (PVC), high density polyethylene (HDPE), polypropylene, nylon, thermoplastic olefin (TPO), or thermoplastic elastomers (TPE) or any material known to one skilled in the art, or mixture of the same. The material can also include rubber, stabilizers, colorant, fire retardants, impact modifiers, fillers, binders, or ultraviolet inhibitors as well as binders for adhering the fibers in the mesh.

In embodiments, the length of material is a contiguous sheet or mat 22 having a non-uniform density across the width of the sheet or mat 22. The density of a longitudinally extending center section 32 proximate the roof slot 18 has a lower density than a longitudinally extending edge section 34 proximate the longitudinally extending edge 26. This difference in density may be a result of using fewer fibers per volume unit in the longitudinally extending center section 32 than in the longitudinally extending edge section 34, while maintaining the same loft (i.e., thickness). Alternatively, the number of fibers may be substantially uniform throughout the sheet or mat 22 with the difference in density resulting from a difference in fiber arrangements. This differential in density allows air to pass through the relatively less dense longitudinally extending center section 32 while the relatively dense longitudinally extending edge section 34 prevents the inflow of materials (e.g., windblown materials or insects) through the ridge vent while still allowing for air to vent.

As shown in FIG. 2, weep holes or weep channels 40 can be formed through the longitudinally extending edge sections 34, for example at a desired spaced interval, to allow moisture to pass from the ridge vent 20 and through the baffles 24. This ensures that moisture does not build-up inside the ridge vent 20.

Alternatively, the ridge vent 20 may be constructed of a plurality of independently fabricated sections having different densities. The independent sections may be connected to one another either directly or indirectly. For example, the independent sections may be directly adhered, by bonding or other method, along their longitudinal edges. Alternatively, the individual sections may each be applied to a backing paper (or other support medium), the backing paper being configured to maintain the spatial relationship between the independent sections.

In some embodiments, as shown in FIGS. 2 and 3, the sheet or mat 22 is molded into a shape that forms a desired low density portion (and thus high air permeability portion) of the structure, while maintaining the loft for thickness of the mat. As shown in FIG. 2, the longitudinally extending center section 32 can be molded to include a plurality of hollow regions 36. The hollow regions 36 can be of any appropriate shape, such as trapezoidal, pyramidal, conical, or cylindrical. As shown best in FIG. 4 the hollow regions 36 can include bases which form part of the bottom surface 30 of the ridge vent 20.

The sheet or matt 22 can also include a fastener line 38 configured for receiving the fastener for attaching the ridge vent 20 to the roof deck 14. The sheet or mat 22 can include two fastener lines 38, on opposing sides of the ridge vent 20 to allow the ridge vent 20 to be attached to the roof deck 14 on either side of the open elongate slot 18. In one embodiment, nails are inserted through the cap shingles 21, the fastener line 38 of the ridge vent, and into the roof deck 14 to secure the cap shingles 21 and ridge vent 20 to the roof deck 14. The fastener line 38 can be a portion of the ridge vent 20 where the hollow regions 36 are spaced apart such that the fastener can pass through a continuous portion of the top surface 28 of the ridge vent 20.

FIG. 5 shows a more detailed partial view of the ridge vent 20 for purposes of illustrating the baffle 24 in more detail. As can be seen in FIG. 5, longitudinally extending edge section includes two portions. A first portion is a non-venting portion that forms a baffle 24 along the longitudinally extending outer surface of the fibrous mesh sheet. That is, the baffle 24 is formed integrally with and from the material that forms the fibrous mat 22, specifically from the longitudinally extending edge section 34. The longitudinally extending edge section 34 includes a venting portion that is inward of the baffle 22. This venting section has a higher air permeability when compared to the portion that forms the baffle 24 but a lower air permeability than portions of the mat 22 that are more central, e.g., than the central section 32 formed from hollow regions 36. That is, the vent portion still allows for the venting of air from the structure but provides resistance to infiltrates and pests.

The baffle 24 forms a relatively air, water and infiltrate impenetrable outer surface along the entire length of the longitudinally extending edge sections 34. In embodiments, the baffle 24 includes a wind deflector lip 24*a* that extends above the upper surface of the matt and outward of the longitudinal side face of the longitudinally extending edge section 34. By relatively impenetrable, it is meant that the baffle surface does not have to be absolutely impenetrable, but should be sufficiently impermeable as to redirect wind incident on the baffle surface upwards and around the wind deflector lip portion 24*a* to create a localized low pressure area over the upper surface of venting portion of the longitudinally extending edge section 34. The baffle 24 prevents wind from passing through the ridge vent 20 (specifically through the longitudinal edge section 34) and into the home. The baffle 24 may alter the airflow around the longitudinally extending edge 26 of the ridge vent 20. As a result, a negative pressure area may be created above the longitudinally extending edge sections 34. This negative pressure area may enhance the venting of air and moisture from the home and out through the ridge vent 20. The wind deflector lip portion 24*a* extends above the top surface 28 of the sheet or mat 22 to direct the airflow around the baffle 24. Additionally, the wind deflector lip portion 24*a* of the baffle 24 may extend at an angle away from the sheet or mat 22. This configuration of upper portion 24*a* helps to control the airflow around the roof vent.

In embodiments, some portion of the longitudinally extending edge section 34 forms the impermeable baffle region (i.e., a non-venting portion or non-venting fiber region) while the remaining portion is air permeable so as to allow air to escape through the sheet or mat 22 (i.e., a venting portion or venting fiber region). In embodiments, the baffle portion can be formed from a relatively small portion of the longitudinally extending edge section horizontal thickness or depth, as long as it functional for its intended purpose. The baffle portion 24 of the mat can have a density which is greater than the remaining portions of the longitudinally extending edge sections 34 from which it is formed, which in turn has a density that is greater than the density of the longitudinally extending center section 32. In such embodiments, the baffle 24 can be constructed of a densely packed mesh such that the baffle 24 is relatively impermeable to airflow. Thus, the exhaust air from the home is forced to exit through the uncovered portions of the longitudinally extending edge sections 34, while wind, rain and infiltrates are largely prevented from passing through the baffle to enter the structure. Such baffles may be constructed by compressing a portion of the longitudinally extending edge section into a relatively more dense region, when compared to both the longitudinally extending edge section 34 and/or longitudinally extending center section 32.

It should be appreciated that this baffle region 24 and the lip portion 24*a* can be made more impermeable than the remainder of the longitudinally extending edge section 34 by several techniques, including localized higher fiber density at the baffle region 24 (with respect to the remainder of the edge section 34), heat treatment along the outer surface of the edge section 34 to fully or partially melt fibers into an impermeable surface or shell, localized compression of the mat in the baffle region, the addition or co-injection of filler additives, such as nylon or TPO (thermoplastic polyolefin), or combinations thereof. In embodiments, an air impermeable membrane may be adhered along the outer surface of the edge section 34 in lieu of or to augment the baffle region that is formed directly from the fibrous mat.

The ridge vent 20 can also include a filter material along the bottom surface 30 of the ridge vent 20 to further prevent debris from entering the open elongate slot 18. The filter can comprise a fabric of non-woven nylon polyester or high loft material, a needle-punched non-woven material, a metal mesh screen, or any other material known to one skilled in the art that prevents debris flow while allowing for the flow of air.

In embodiments, a roof ridge vent assembly includes a roof ridge assembly 10 with an open elongate slot 18, a ridge vent 20 according to the embodiments described herein, and at least one cap shingle 21. The cap shingle 21 overlies the ridge vent 20 and open elongate slot 18. The cap shingles 21 can be configured to overlie the longitudinally extending center section 32 but leave at least a portion of the longitudinally extending edge sections 34 exposed. This allows air to escape through the longitudinally extending edge sections, as shown in FIG. 4.

Figure 6:
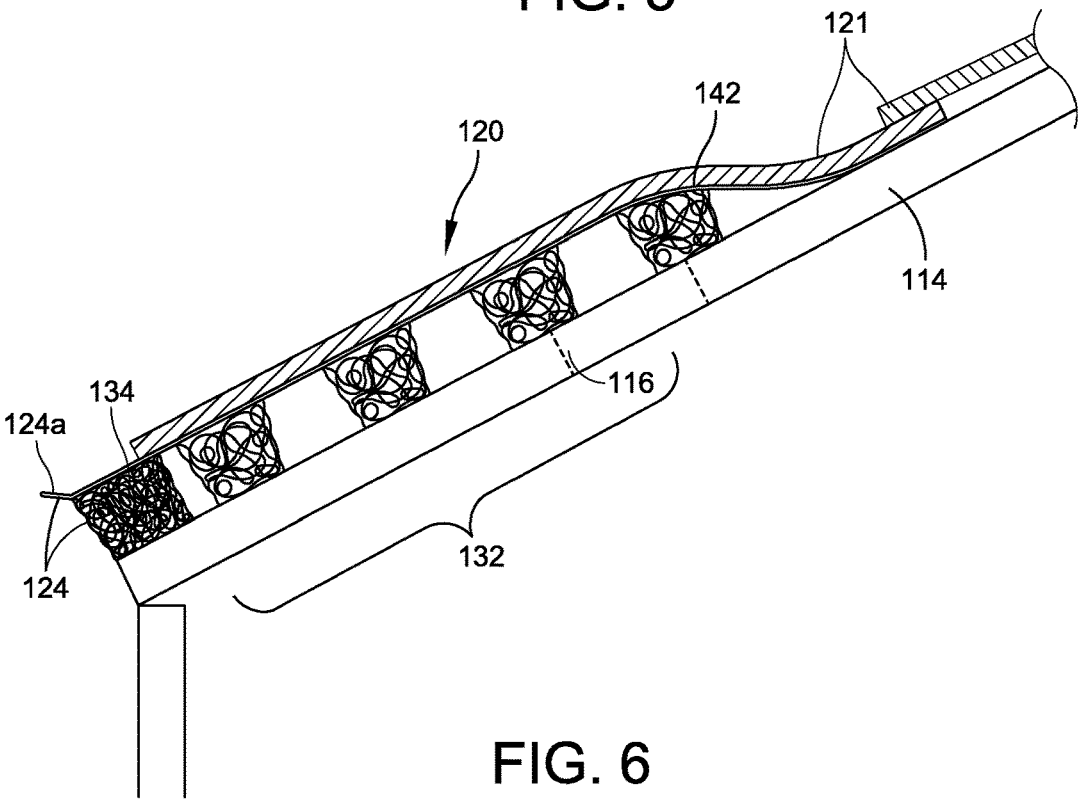
FIG. 6 is a cross-sectional side view of an edge vent.

In other embodiments, a roof vent can be configured as a vent to be positioned on other sections of a home or other structure. For example, as shown in FIG. 6, an edge vent 120 can be disposed along the edge of a roof deck 114, near where the roof deck 114 meets a sidewall of the home. In such an embodiment, edge vent 120 includes a longitudinally extending center section 132, a longitudinally extending edge section 134 and a baffle 124 having upwardly and outwardly extending wind deflector lip portion 124*a*. Opposite the longitudinally extending edge section 134 is an extension 142 which is configured to extend from the top surface of the edge vent 120 to the roof deck 114. Shingles 121 may overlie the extension 142, the longitudinally extending center section 132, and, optionally, a portion of the longitudinally extending edge section 134. The center section 132 is installed over a vent slot 116 in the roof deck 114. Such an embodiment may be positioned over an open area near the edge of the roof which allows air to escape therefrom and through the longitudinally extending edge section 134. The extension 142 may be a separate sheet of material to which the fibrous sheet forming the vent is attached or an area formed by compressing the fibrous sheet or mat.

Figure 7:
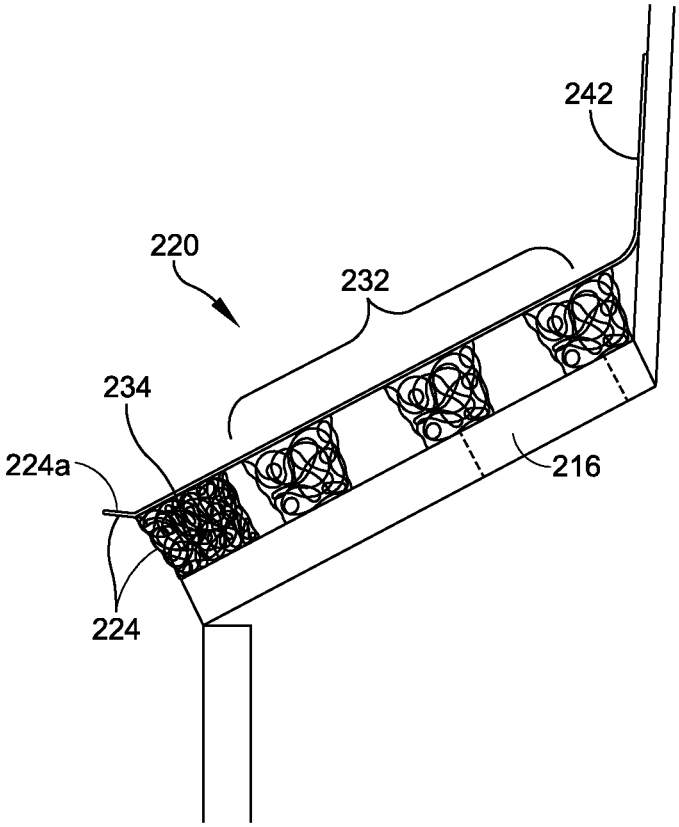
FIG. 7 is a cross-sectional view of roof vent disposed at the intersection of a sidewall and an overhang.

In other embodiments, as shown in FIG. 7, a roof vent 220 can be positioned at the intersection of a sidewall and awning or other overhang. Such a roof vent can be configured substantially similar to the edge vent 120 as described above with respect to FIG. 6. That is, the roof vent 220 has an integral baffle 224 having a wind deflector lip portion 224*a*, longitudinally extending edge section 234 and center section 232. The roof vent 220 is installed over a slot 216 in the roof. However, in the embodiment shown in FIG. 7, the extension 242 is configured to extend along the sidewall. Shingles may be positioned over a portion of the roof vent 220 also as described above with respect to edge vent 120.

In other embodiments, a method of manufacturing a ridge vent having integrated baffles is provided. The method includes the steps of forming a continuous length of material having a top surface, a bottom surface, and a longitudinally extending center section disposed between a pair of longitudinally extending edges of the material. Additives, such as ultraviolet inhibitors, can be added to the material. The method further includes forming an integrated baffle along the longitudinally extending edges. The baffle may be formed by stamping, ironing, melting, forming, molding or otherwise shaping the material. The method may also include the forming of weep holes within the baffles. After forming, the ridge vent can be rolled for easier storage and shipment.

Figure 8:
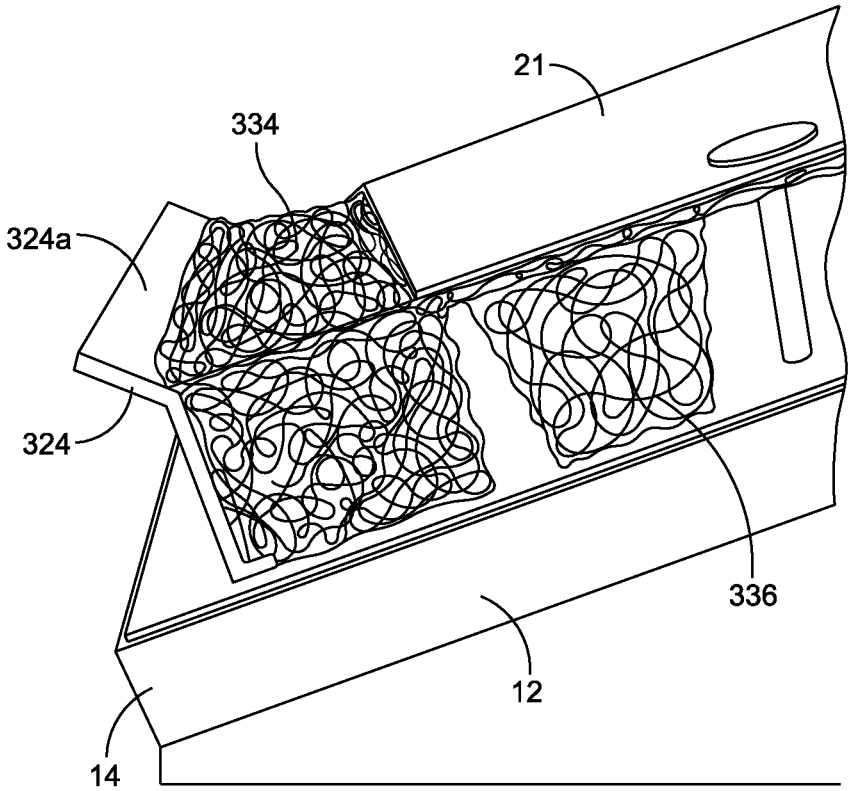
FIG. 8 is a detail view of a roof vent with a baffle attached thereto.

In other embodiments, as shown in FIG. 8, a roof vent includes a longitudinally extending center section, having hollow low density regions 336, disposed between a pair of longitudinally extending edges. The roof vent further includes a pair of longitudinally extending higher density edge sections 334 adjacent to the longitudinally extending edges. In contrast to the embodiments described above, the roof vent also includes a pair of baffles 324, having upwardly and outwardly extending wind deflector lip portions 324*a*, that are separately fabricated and attached to the longitudinally extending edges, as opposed to integrally formed from the fiber material forming the mat that forms the main body of the vent. The baffles 324 can be formed from any material that is sufficiently air impermeable (so as to ensure wind deflection). In embodiments, baffles 324 are formed from polypropylene, nylon, polyethylene, polyvinyl chloride (PVC), thermoplastic olefin (TPO), or thermoplastic elastomers (TPE). These materials may contain modifiers such as rubber, stabilizers, colorant, fire retardants, ultraviolet inhibitors, impact modifiers, fillers, or binders. The baffles 324 can be attached by bonding, pressing, adhering or any other process known to one skilled in the art.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A roof vent comprising:

a continuous elongate mat composed of a mesh of randomly oriented fibers, wherein the mat has a top surface, a bottom surface, and a first longitudinally extending side surface connecting the top and bottom surfaces, wherein a portion of the mesh proximate to and forming the first longitudinally extending side surface is configured as a wind baffle, wherein the wind baffle includes a wind deflector lip, formed from the mesh, which extends above the top surface of the mat, wherein the mat comprises a longitudinally extending center section having a first air permeability and a longitudinally extending edge section between the longitudinally extending center section and the first longitudinally extending side surface, wherein a venting portion of the longitudinally extending edge section disposed adjacent to the longitudinally extending center section has a second air permeability, and wherein the longitudinally extending center section is more permeable than the venting portion of the longitudinally extending edge section, wherein the first longitudinally extending side surface is less permeable than the venting portion of the longitudinally extending edge section, wherein a portion of the top surface of the mat over the venting portion of the longitudinally extending edge section is uncovered to allow for venting through the top surface of the mat, and wherein the first longitudinally extending side surface is relatively impermeable to air flow such that venting is directed through the top surface of the mat.

2. The roof vent of claim 1, wherein the venting portion of the longitudinally extending edge section has a density that is greater than a density of the longitudinally extending center section.

3. The roof vent of claim 1, wherein the wind baffle is formed from a non-venting portion of the longitudinally extending edge section, the non-venting portion being less permeable than the venting portion of the longitudinally extending edge section.

4. The roof vent of claim 3, wherein the non-venting portion of the longitudinally extending edge section has a density that is greater than the density of the venting portion of the longitudinally extending edge section.

5. The roof vent of claim 1, wherein the longitudinally extending center section includes a plurality of hollow regions, the hollow regions having bases formed from the mesh, and further wherein the bases form part of the bottom surface.

6. The roof vent of claim 1, wherein the wind baffle includes a weep hole extending through the wind baffle.

7. The roof vent of claim 1, wherein the wind deflector lip of the wind baffle is angled outward of the longitudinally extending side surface.

8. The roof vent of claim 1, wherein the mat has a second longitudinally extending side surface, wherein a portion of the mat proximate to and forming the second longitudinally extending side surface is configured as a second wind baffle, wherein the second wind baffle includes a second wind deflector lip, formed from the mesh, which extends above the top surface of the mat.

9. The roof vent of claim 1, wherein the portion of the mat proximate to and forming the first longitudinally extending side surface forms an outer shell for the mat.

10. The roof vent of claim 1, wherein the portion of the mat proximate to and forming the first longitudinally extending side surface:

has a higher fiber density than venting portions of the mat, comprises an additive for decreasing air permeability of the mat, comprises a compressed fiber region, comprises a melted fiber region, or a combination thereof.

11. A roof vent comprising:

a continuous elongate mat composed of a mesh of randomly oriented fibers, wherein the mat has a top surface, a bottom surface, a longitudinally extending center section disposed between first and second longitudinally extending side surfaces connecting the top and bottom surfaces, first and second longitudinally extending edge sections disposed between the center section and including the first and second longitudinally extending side surfaces, respectively, wherein the first and second longitudinally extending edge sections each include a non-venting fiber region proximate to and forming the first and second side surfaces, respectively, configured as a wind baffle formed from the mesh, and a venting fiber region disposed between the non-venting fiber region and the longitudinally extending center region of the mat, wherein a portion of the top surface of the mat over the venting fiber regions of the first and second longitudinally extending edge sections are uncovered to allow for venting through the top surface of the mat, wherein the longitudinally extending center section has a first air permeability, the venting fiber regions of the first and second longitudinally extending edge sections have a second air permeability less than the first air permeability, and the non-venting fiber regions of the first and second longitudinally extending edge sections have a third air permeability less than second air permeability, wherein the vent is configured such that an air flow path for venting air from a structure to which the vent is coupled is formed from the longitudinally extending center section through the first and second longitudinally extending edge sections to the surrounding environment when an upper surface of the longitudinally extending center section is covered and the venting fiber regions of the first and second longitudinally extending edge sections are exposed, and wherein the non-venting fiber regions of the first and second longitudinally extending edge sections are relatively impermeable to air flow such that venting is directed through the top surface of the mat in the venting fiber regions.

12. The roof vent of claim 11, wherein the center section, venting fiber regions, and non-venting fiber regions have first, second and third densities, respectively, with the third density being greater than the second density and the second density being greater than the first density.

13. The roof vent of claim 11, wherein the non-venting fiber regions have a higher fiber density than the venting fiber regions, wherein the non-venting fiber regions include an additive for decreasing air permeability of the mat, wherein the non-venting fiber regions comprise a compressed fiber region, or wherein the non-venting finer region comprises a melted fiber region.

14. The roof vent of claim 11, wherein the wind baffles each includes a wind deflector lip extending above the top surface of the mat and angled outward of the respective longitudinally extending side surface.

15. The roof vent of claim 11, wherein each wind baffle includes a weep hole extending through the wind baffle.

16. A roof vent assembly comprising:

a roof deck with an open elongate slot;

a roof vent overlying the open elongate slot, wherein the roof vent includes:

a continuous elongate mat composed of a mesh of randomly oriented fibers, wherein the mat has a top surface, a bottom surface, and a first longitudinally extending side surface connecting the top and bottom surfaces, wherein a portion of the mesh proximate to and forming the first longitudinally extending side surface is configured as a wind baffle, wherein the wind baffle includes a wind deflector lip, formed from the mesh, which extends above the top surface of the mat, wherein the mat comprises a longitudinally extending center section having a first air permeability and a longitudinally extending edge section between the longitudinally extending center section and the first longitudinally extending side surface, wherein a venting portion of the longitudinally extending edge section disposed adjacent to the longitudinally extending center section has a second air permeability, and wherein the longitudinally extending center section is more permeable than the venting portion of the longitudinally extending edge section, wherein the first longitudinally extending side surface is less permeable than the venting portion of the longitudinally extending edge section, wherein a portion of the top surface of the mat over the venting portion of the longitudinally extending edge section is uncovered to allow for venting through the top surface of the mat, and wherein the first longitudinally extending side surface is relatively impermeable to air flow such that venting is directed through the top surface of the mat; and at least one cap shingle overlying the roof vent and the open elongate slot;

wherein the cap shingle partially overlies the top surface of the mat, such that a portion of the roof vent disposed between the wind baffle and the cap shingle is exposed to provide a ventilation opening.

17. The roof vent assembly of claim 16, wherein the cap shingle covers the longitudinally extending center section and partially overlies the venting portion of the longitudinally extending edge section.

18. The roof vent assembly of claim 16, wherein the roof vent is positioned at the intersection of a sidewall and the roof deck or at an edge of the roof deck.

19. The roof vent assembly of claim 16, wherein the roof vent is a roof ridge vent and the elongate slot is at a roof ridge, and wherein the mat has a second longitudinally extending side surface, wherein a portion of the mat proximate to and forming the second longitudinally extending side surface is configured as a second wind baffle, wherein the second wind baffle includes a second wind deflector lip, formed from the mesh, which extends above the top surface of the mat.

20. The roof vent assembly of claim 16, wherein the portion of the mat proximate to and forming the first longitudinally extending side surface:

has a higher fiber density than venting portions of the mat, comprises an additive for decreasing air permeability of the mat, comprises a compressed fiber region, comprises a melted fiber region, or a combination thereof.

* * * * *